United States Patent [19]

Gibilaro

[11] 4,030,286

[45] June 21, 1977

[54] LINK DRIVE CHAIN REPAIR TOOL

[76] Inventor: Frank Gibilaro, 55 Ferndale Court, Copiague, Long Island, N.Y. 11726

[22] Filed: July 19, 1976

[21] Appl. No.: 706,269

[52] U.S. Cl. ..... 59/7

[51] Int. Cl.[2] ..... B21L 21/00

[58] Field of Search ..... 59/7, 11, 3, 35; 269/54.5, 101

[56] References Cited

UNITED STATES PATENTS

| | | | |
|---|---|---|---|
| 1,677,659 | 7/1928 | Saffold | 59/3 |
| 2,917,893 | 12/1959 | Kausche | 59/7 |
| 3,075,347 | 1/1963 | Bonifas | 59/7 |
| 3,172,250 | 3/1965 | Eastep | 59/7 |
| 3,553,960 | 1/1971 | Ellefson | 59/7 |

*Primary Examiner*—C.W. Lanham

*Assistant Examiner*—Gene P. Crosby

*Attorney, Agent, or Firm*—Joel Halpern

[57] ABSTRACT

A link drive chain repair tool includes a base plate upon which a pair of upstanding longitudinally aligned stud elements extend from its upper face. Clamping means depend from the lower face of the base plate for clamping of the base plate to a surface of the machine driven by the drive chain. One of the stud elements is threaded so as to receive a clamp nut thereon to receive the drive chain to the base plate. A pair of elongated link support members are positioned in spaced parallel relation on the upper face of the base plate to one side of the aligned stud elements so as to be adapted to provide lateral support for an adjacent pair of inner links of the drive chain during removal of a connecting outer link.

6 Claims, 3 Drawing Figures

LINK DRIVE CHAIN REPAIR TOOL

BACKGROUND OF THE INVENTION

The present invention relates to drive chain repair tools and more particularly to a tool applicable to the repair of linktype drive chains in which pairs of adjacent inner links are connected by means of outer links.

Tools for use in the repair of link-type chains have been known heretofore. However such tools were generally required to be held by hand and did not provide adequate lateral bearing support for the links during the removal of the connecting outer link. Typical of such hand-held tools is the repair tool disclosed in U.S. Pat. No. 1,994,270 issued Mar. 12, 1935 to E. Cetrano. The patented device provided an elongated bar, a pair of block-shaped slides adapted to ride along the bar, and a pair of handle levers pivotably mounted on the bar and adapted to retain the slide members in a selected position retaining the spaced ends of the chain in substantially fixed spatial end-to-end relationship in order to perform the repair.

As stated above, the principal disadvantages of such tools were the inconvenience of having to hold the tool during the repair operation and the fact that insufficient lateral bearing support was provided for the inner links during the removal and replacement of the connecting outer link. Consequently, it was frequently difficult and time consuming to make the necessary repairs. It was not uncommon to require the cooperation of two workmen, one of whom simply held the tool and supported the drive chain while the other workman performed the repair work.

SUMMARY OF THE INVENTION

It is one object of the invention to provide a tool for the repair of link-type drive chains which is manipulable by a single workman and can be clamped to the machine under repair.

It is another object of the invention to provide a linktype drive chain repair tool which provides adequate lateral bearing support for the adjacent inner links of the drive chain during removal and replacement of the connecting outer link.

Other objects and advantages of the invention will become readily apparent from the following description of the invention.

According to the present invention there is provided . . . claim 1.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
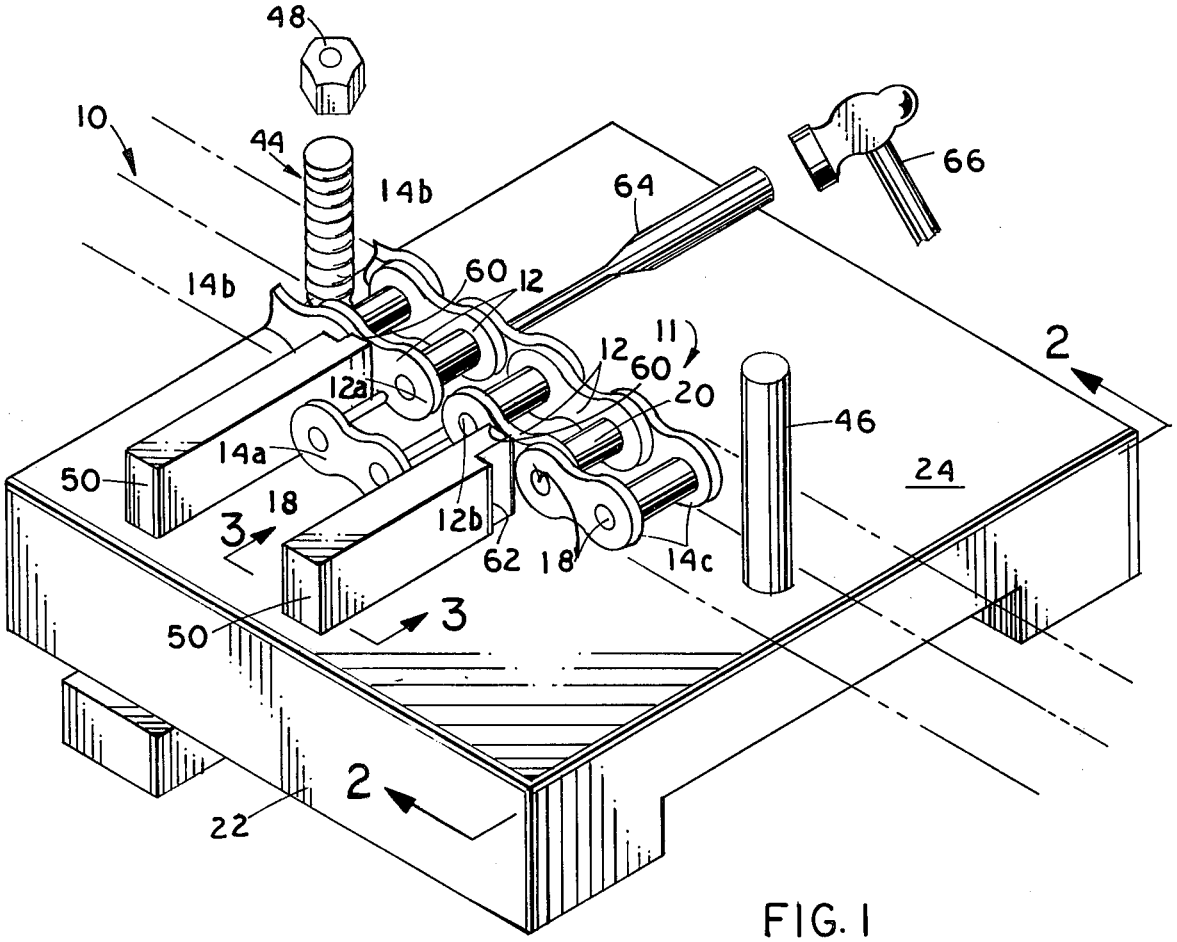
FIG. 1 is a perspective view of a repair tool for linktype drive chains embodying the features of the invention.
Figure 2:
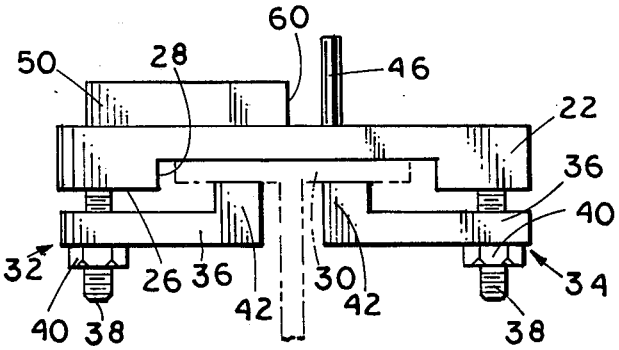
FIG. 2 is an end elevational view of the repair tool shown in FIG. 1, taken in the direction of arrows 2—2.

Referring to the drawings there is shown generally, as indicated by reference numeral 10, a repair tool adapted for the repair of a drive chain 11 of the type in which a series of pairs of opposed inner links 12 are connected by means of outer links 14. Pins 18 or headed rivets are usually inserted through aligned openings in the inner and outer links, and a rotatable sleeve 20 is generally positioned over the pins 18 to facilitate driving of the drive chain by a sprocket (not shown) with the minimum amount of wear.

As can be seen clearly from FIG. 1 the repair tool comprises a base plate 22 which may be of rectangular or square rectilinear configuration with a substantially planar upper face 24 and a lower face 26. It is convenient to provide the lower face of the base plate with a longitudinally extending recessed portion 28 adapted to receive a portion 30 of the machine under repair. Such portion may be a rail or track element or the like but in any event will generally be the portion of the machine which underlies the drive chain. It will be observed that a pair of clamp assemblies 32, 34 depend from the lower surface of the base plate in order to effectuate such clamping of the underlying machine surface. The clamping assemblies may each consist of a clamp arm 36 which is apertured to ride along a threaded clamping stud 38. A clamp nut 40 can be tightened on its stud to draw a clamping boss 42 on the clamp arm into clamping engagement with the machine surface or rail.

A pair of stud elements 44, 46 are mounted in the base plate in longitudinally aligned relation and project upwardly from the upper face of the base plate. One of such stud elements 44 is threaded so as to receive a clamp nut 48 thereon to retain one end of the drive chain 11 during performance of the repair work. The other stud element may be removably positioned within an aperture in the base plate such as through threaded engagement within such aperture. It will be noted from FIG. 1 that the length of the stud elements 44, 46 should be sufficient to allow them to extend above the height of the drive chain to be repaired.

Figure 3:
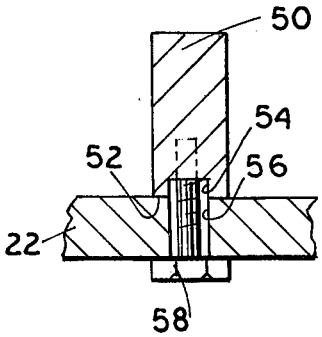
FIG. 3 is a fragmentary side elevational view partly in cross-section, showing the adjustable connection between the base plate and one of the link support members, of the repair tool shown in FIG. 1 and taken along line 3—3 thereof.

A pair of elongated link support members 50 are mounted on the upper face of the base plate intermediate and stud elements 44, 46 and to one side of the longitudinal line running through such stud elements. The link support members are elongated and bar-like, extending transversely of the base plate in spaced parallel relation to each other. They are adapted to provide lateral bearing support for an adjacent pair of inner links **12*a*, 12*b* during removal of and replacement of their connecting outer link 14*a*. Generally the link support members are fixedly secured to the base plate in a permanent manner such as by welding. However, FIG. 3 illustrates an embodiment wherein such support members may be slidable relative to the base plate so as to be positionable in any desired transverse position relative to the stud elements 44, 46 and drive chain 11 before being secured to the base plate against movement during the repair operation. Thus, as shown in FIG. 3 the lower surface 52 of each link support member may be given a longitudinally extending slot 54. The base plate is provided with a pair of spaced transversely extending slots 56, and fastening means 58** such as a threaded bolt may be employed to secure the link support members to the base plate at the selected transverse positions.

As shown in FIG. 1 each of the link support members is bar-like in configuration and has a vertical front face 60. A portion of the front face is cut away adjacent one edge to thereby provide a recessed vertically extending shoulder 62. The depth of the recess is approximately the equivalent of the thickness of a standard drive chain link. In this manner when the drive chain is to be repaired one end of the chain or that portion adjacent the link or links to be repaired or replaced is slipped over the clamp stud 44 and nut 48 is threaded thereon to secure the drive chain against longitudinal movement. The other end of the drive chain or, if the chain is unbroken, the portion of the chain which overlies stud element 46 is slipped thereover. The drive chain, prior to tightening of clamp nut 48, may be shifted laterally such that the end peripheral portions of outer links **14*b* and 14*c* are brought into close abutment against the recessed shoulders of the link support members. The clamp nut is then tightened to maintain the drive chain in such position. A drift pin 64 can then be driven against the pin connecting the inner and outer links by means of a hammer 66 to effect removal of the outer link 14*a* as shown in FIG. 1.**

From the foregoing it will be seen that a relatively simple repair tool has been provided to effect the repair of link-type drive chains in a manner resulting in a savings in man-hours and facilitating accurate alignment of the chain links with the lateral support members to expedite the repairs.

I claim:

1. A link drive chain repair tool comprising in combination:

a base plate having upper and lower faces;

a pair of longitudinally aligned stud elements mounted on said base plate and projecting upwardly from the upper face thereof;

a pair of link support members mounted on said upper face of said base plate intermediate said stud elements to one side thereof and extending in spaced parallel relation to each other so as to provide lateral bearing support for an adjacent pair of inner chain links during removal and replacement of an outer link connecting said inner links;

and clamping means depending from said base plate adapted to clamp said tool to a portion of a machine driven by the link drive chain which underlies the drive chain.

2. A repair tool according to claim 1, including a longitudinally extending recess formed in said lower face of said base plate adapted to receive the clamped portion of the machine therein.

3. A repair tool according to claim 1, wherein one of said stud elements is threaded and provided with a clamp nut for securing the drive chain against longitudinal movement.

4. A repair tool according to claim 1, wherein each of said link support members comprises an elongated generally rectangular block having an end face adjacent an imaginary longitudinal line running through said stud elements, said end face extending vertically and being cut away along one vertical edge to form a recessed vertically extending shoulder, the depth of the recess being approximately equivalent to the thickness of a standard drive chain link, whereby the drive chain to be repaired can be positioned on said stud elements such that the peripheral end portion of each of a pair of adjacent outer links are brought into close abutment with the recessed shoulders of the corresponding link support members.

5. A repair tool according to claim 1, including a longitudinally extending slot formed in the lower surface of each of said link support members and a pair of spaced parallel transversely-extending slots formed in said base plate and fastening means insertable through the slots of said link support members and base plate for securing said link support members in fixed relation to said base plate at selected transverse positions relative to said stud elements.

6. A repair tool according to claim 1, wherein said link support members are permanently secured to said base plate.

* * * * *